US008915496B2

(12) United States Patent
Hung et al.

(10) Patent No.: US 8,915,496 B2
(45) Date of Patent: Dec. 23, 2014

(54) FEEDING APPARATUS

(71) Applicant: Foxlink Image Technology Co., Ltd., New Taipei (TW)

(72) Inventors: Che-Pin Hung, New Taipei (TW); Yueh-Shing Lee, New Taipei (TW); Shao-Yang Wu, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 152 days.

(21) Appl. No.: 13/656,171

(22) Filed: Oct. 19, 2012

(65) Prior Publication Data

US 2014/0110898 A1 Apr. 24, 2014

(51) Int. Cl.
*B65H 3/52* (2006.01)

(52) U.S. Cl.
USPC ..... 271/121

(58) Field of Classification Search
CPC ..... B65H 5/025; B65H 3/22; B65H 3/063; B65H 2511/514; B65H 5/062; B65H 3/0669; B65H 3/5261; B65H 3/5223; B65H 3/56; B65H 3/5246; B41J 13/103; G03G 15/60; A41H 43/02
USPC ..... 271/4.01, 4.08, 4.1, 10.01, 10.09, 271/10.11, 10.13, 121, 125
See application file for complete search history.

(56) References Cited

U.S. PATENT DOCUMENTS 4,585,218 A * 4/1986 Williams et al. ..... 271/10.04
4,607,833 A * 8/1986 Svyatsky et al. ..... 271/10.03
5,344,134 A * 9/1994 Saeki et al. ..... 271/122

* cited by examiner

*Primary Examiner* — Thomas Morrison
(74) *Attorney, Agent, or Firm* — Muncy, Geissler, Olds & Lowe, P.C.

(57) ABSTRACT

A feeding apparatus includes a pickup roller arranged to pick and feed a medium downstream along a conveying path, a separating roller arranged downstream to the pickup roller for advancing the medium downstream, a brake roller arranged opposite to the separating roller, and a pressing structure arranged opposite to the pickup roller and operable to swing toward or away from the pickup roller according to the rotating direction of the brake roller. When the brake roller rotates for feeding mediums downstream, the pressing structure moves toward the pickup roller and applies a normal force required for picking the medium. But when the brake roller stops rotating downstream because multiple mediums are fed between the brake roller and the separating roller, the pressing structure moves away from the pickup roller and stops applying normal force, so as to control the medium-picking process.

3 Claims, 12 Drawing Sheets

FEEDING APPARATUS

BACKGROUND OF THE INVENTION

1. Field of the Invention

The present invention relates to a feeding apparatus capable of separating and transmitting sheet-like mediums piece by piece.

2. The Related Art

Referring to FIG. 1, a conventional feeding apparatus is used to separate and transmit sheet-like mediums 90. The feeding apparatus includes a pickup mechanism 91 arranged to pick and drive the medium 90 and a separating mechanism 92 arranged downstream to the pickup mechanism 91 for separating and transmitting the mediums 90 piece by piece. When more than one medium 90 are fed to the downstream region of the separating mechanism 92 (so-called multiple feed), it will cause an error of processing the medium 90. So, many technical improvements of the feeding apparatuses are trying to avoid the occurrence of multiple feed.

Such as the conventional feeding apparatus shown in FIG. 1, the pickup mechanism 91 includes a pickup roller 911 and a pressing structure 912. The pickup roller 911 is contacted with the medium 90 and rotatable to drive the medium 90 to move along a conveying path 93. The pressing structure 912 controls the normal force between the medium 90 and the pickup roller 911. The separating mechanism 92 includes a separating roller 921 and a brake roller 922 arranged at the both sides of the conveying path 93 relatively. If, for example, two mediums 90 enter between the separating roller 921 and the brake roller 922, the medium 90 that contacts with the separating roller 921 will keep moving downstream along the conveying path 93, but the medium 90 that contacts with the brake roller 922 will be stopped by the brake roller 922 and stays in the separating mechanism 92. With this, the mediums 90 can be transmitted along the conveying path 93 piece by piece.

In order to avoid more mediums 90 being further fed into the separating mechanism 92 while there is one medium 90 in the separating mechanism 92 already, a sensor 94 is arranged inside the separating mechanism 92 and connected with a control unit 95. When the sensor 94 detects there are more than one medium 90 in the separating mechanism 92, the control unit 95 will control the pressing structure 912 to lift the pickup roller 911 away from the surface of the medium 90. With this, other mediums 90 will not be fed into the separating mechanism 92 while there is one medium 90 in the separating mechanism 92 already.

However, the overall structure of this conventional feeding apparatus is too complex. It includes not only the sensor 94 and the control unit 95, but also an actuator or a power transmitting structure (not shown) arranged to drive the pressing structure 912. As a result, its production costs are quite high.

In view of these disadvantages above, the conventional feeding apparatus needs to be improved.

SUMMARY OF THE INVENTION

An objective of the present invention is to provide a feeding apparatus which can increase the reliability of picking medium and stop picking mediums automatically when more than one medium are overlap in the feeding apparatus for avoiding multiple feed.

To reach such purpose, the feeding apparatus is adapted for an office machine. The office machine defines a conveying path for transmitting a sheet-like medium therethrough. The feeding apparatus is arranged on the conveying path.

The feeding apparatus includes a pickup roller that is arranged to contact with the medium and rotatable to transfer the medium downstream along the conveying path, a separating roller that is arranged downstream to the pickup roller in the conveying path for receiving the medium transmitted by the pickup roller and that is rotatable to further advance the medium downstream along the conveying path, a brake roller that is arranged opposite to the separating roller for applying a braking force upstream, and a pressing structure including a pressing part that is arranged opposite to the pickup roller. The brake roller is pivoted to the pressing structure. A first torque limiter is connected with the brake roller and the pressing structure to drive the pressing part to swing toward or away from the pickup roller according to the rotating direction of the brake roller.

When only one medium is transmitted between the separating roller and the brake roller, the brake roller will rotates along with the separating roller downstream and drives the pressing structure to swing the pressing part toward the pickup roller by virtue of the first torque limiter so as to apply the normal force onto the mediums for the convenience of the pickup roller picking the medium. When more than one medium are transmitted between the separating roller and the brake roller, the brake roller stops rotating along with the separating roller and stops the mediums which are not contacted with the separating roller because friction forces among the mediums are smaller than the braking force of the brake roller. The brake roller further drives the pressing structure to swing the pressing part away from the pickup roller by virtue of the first torque limiter so as to reduce the normal force between the pickup roller and the medium and avoid more mediums being further transmitted downstream.

As described above, the pressing structure is linked with the brake roller and receives the driving torque for applying normal force to the medium from the brake roller. Therefore, when multiple mediums are fed between the separating roller and the brake roller, the pressing structure will lost the driving torque from the brake roller so as to cut off the normal force and the friction force between the pickup roller and the medium automatically. As a resolute, the pickup roller can no longer pick and feed the medium when there are more than one medium between the separating roller and the brake roller, to reduce the occurrence of multiple feed. In addition, the overall structure of the feeding apparatus of the present invention is very simple and the normal force applied by the pressing structure can be automatically regulated via the cooperation of the brake roller, the pressing structure and the first torque limiter without setting any sensor or control unit.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
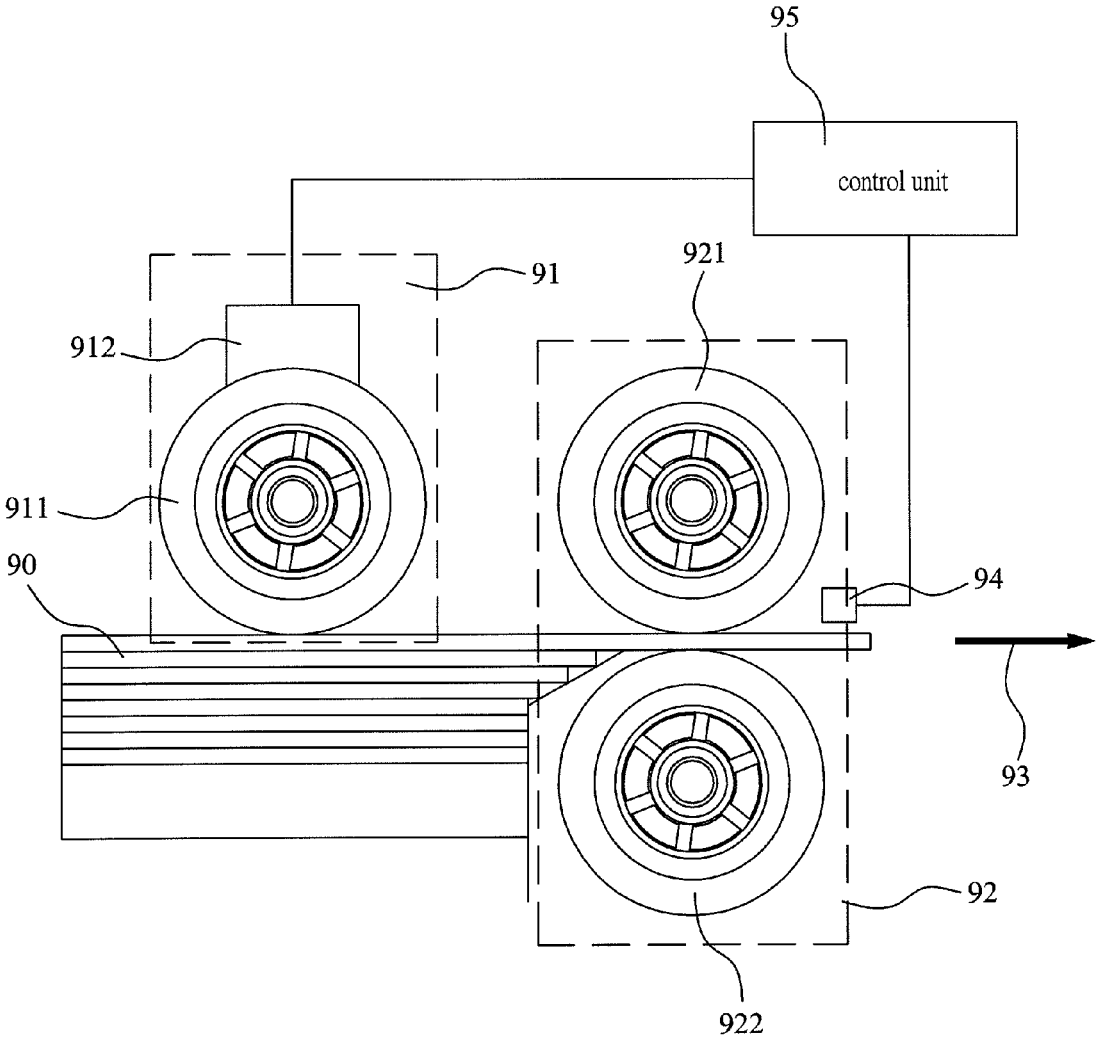
FIG. 1 (Prior Art)
FIG. 1 shows a cross-sectional view of a common feeding apparatus.
Figure 2:
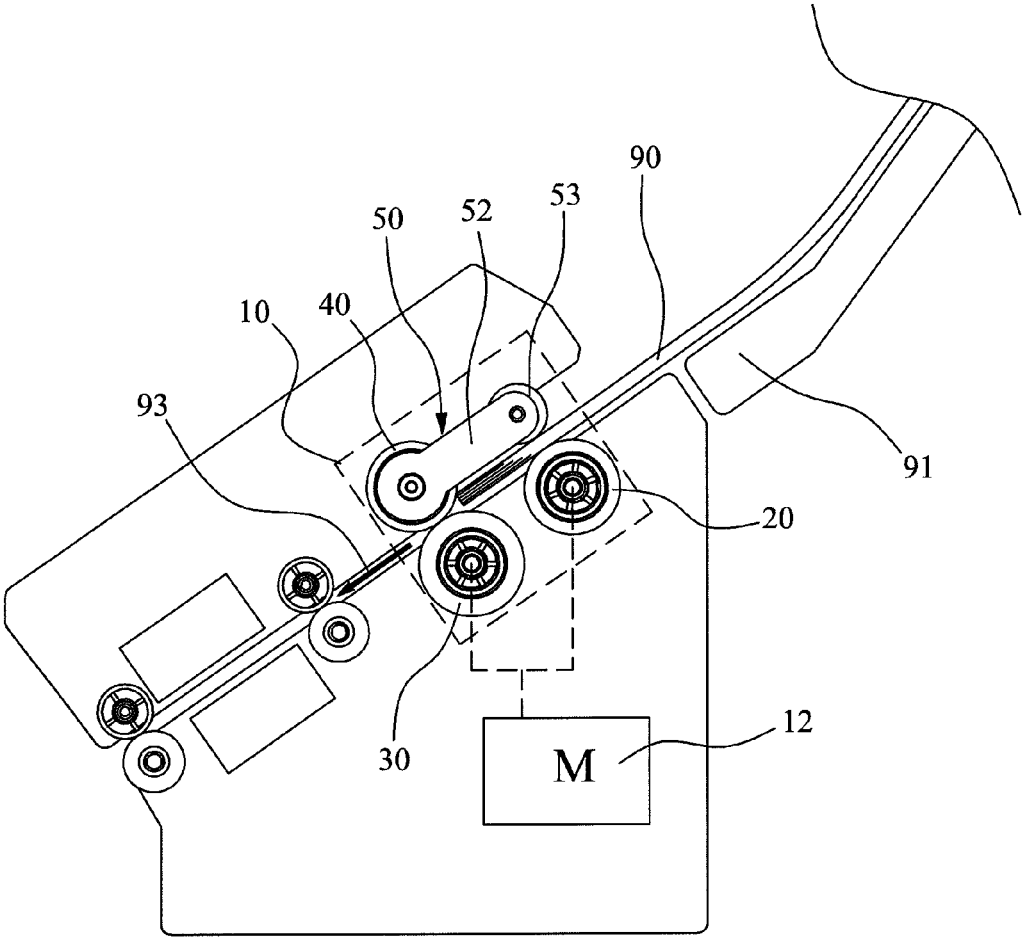
FIG. 2 shows a cross-sectional view of a feeding apparatus in accordance with a first embodiment of this invention, wherein the feeding apparatus is used in an office machine.
Figure 3:
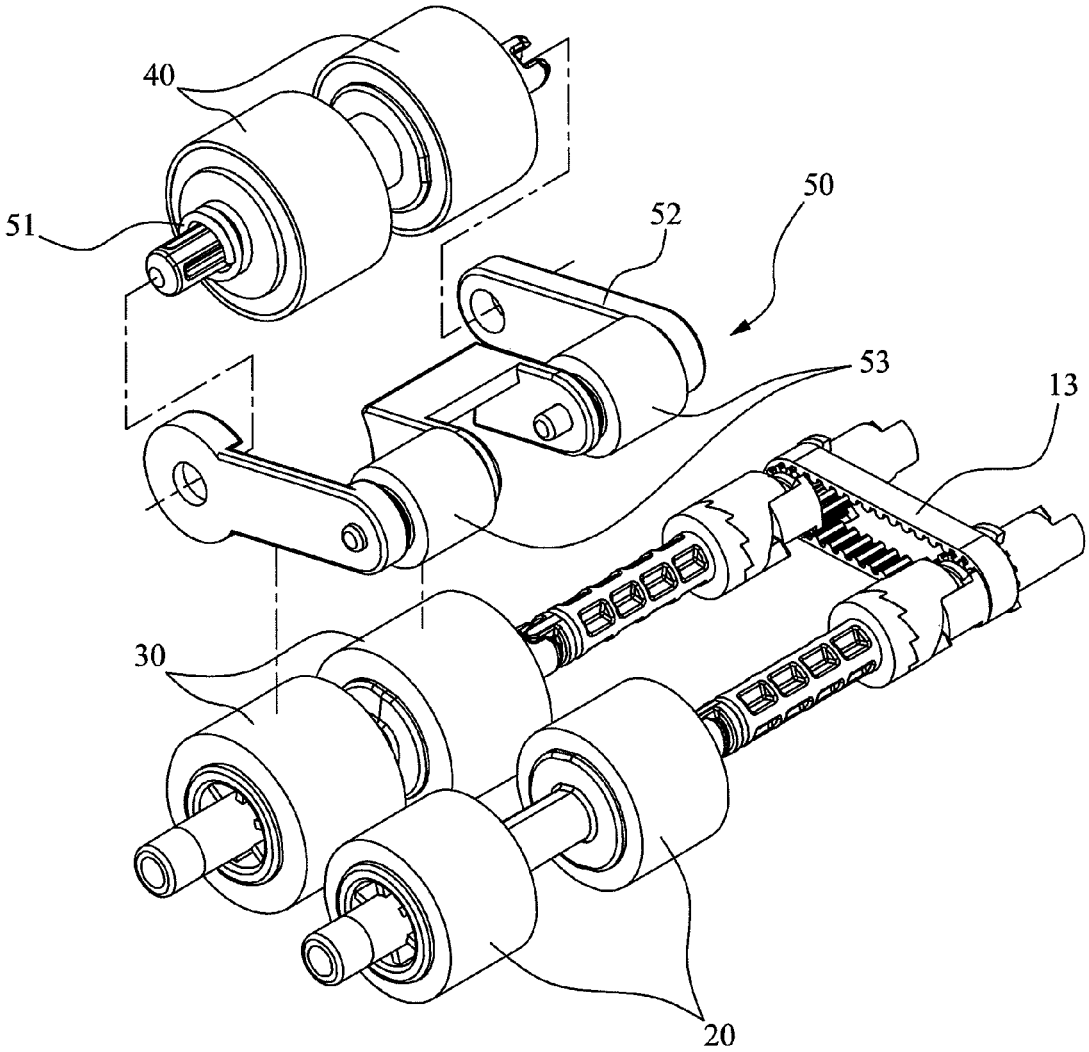
FIG. 3 shows an exploded view of the feeding apparatus shown in FIG. 2.

Referring to FIG. 2 and FIG. 3, a feeding apparatus 10 according to a first embodiment of the present invention is adapted for an office machine. The office machine defines a conveying path 93 for transmitting a sheet-like medium 90 therethrough. The feeding apparatus 10 is arranged on the conveying path 93.

The feeding apparatus 10 includes a pickup roller 20, a separating roller 30, a brake roller 40 and a pressing structure 50. The pickup roller 20 is arranged to contact with the medium 90 and rotatable to transmit the medium 90 downstream along the conveying path 93. The separating roller 30 is arranged downstream to the pickup roller 20 in the conveying path 93 for receiving the medium 90 transmitted by the pickup roller 20. The separating roller 30 is rotatable to further advance the medium 90 downstream along the conveying path 93. The brake roller 40 is arranged opposite to the separating roller 30 for applying a braking force upstream. The pressing structure 50 includes a pressing part arranged opposite to the pickup roller 20. The brake roller 40 is pivoted to the pressing structure 50. A first torque limiter 51 is connected with the brake roller 40 and the pressing structure 50 to drive the pressing part to swing toward or away from the pickup roller 20 according to the rotating direction of the brake roller 40.

When only one medium 90 is transmitted between the separating roller 30 and the brake roller 40, the brake roller 40 rotates along with the separating roller 30 downstream and drives the pressing structure 50 to swing the pressing part toward the pickup roller 20 by virtue of the first torque limiter 51 so as to apply the normal force onto the mediums 90 for the convenience of the pickup roller 20 picking the medium 90. When more than one medium 90 are transmitted between the separating roller 30 and the brake roller 40, the brake roller 40 will stop rotating along with the separating roller 30 and stop the mediums 90 which are not contacted with the separating roller 30 because friction forces among the mediums 90 are smaller than the braking force of the brake roller 40. The brake roller 40 further drives the pressing structure 50 to swing the pressing part away from the pickup roller 20 by virtue of the first torque limiter 51 so as to reduce the normal force between the pickup roller 20 and the medium 90 and avoid more mediums 90 being further transmitted downstream.

Figure 4:
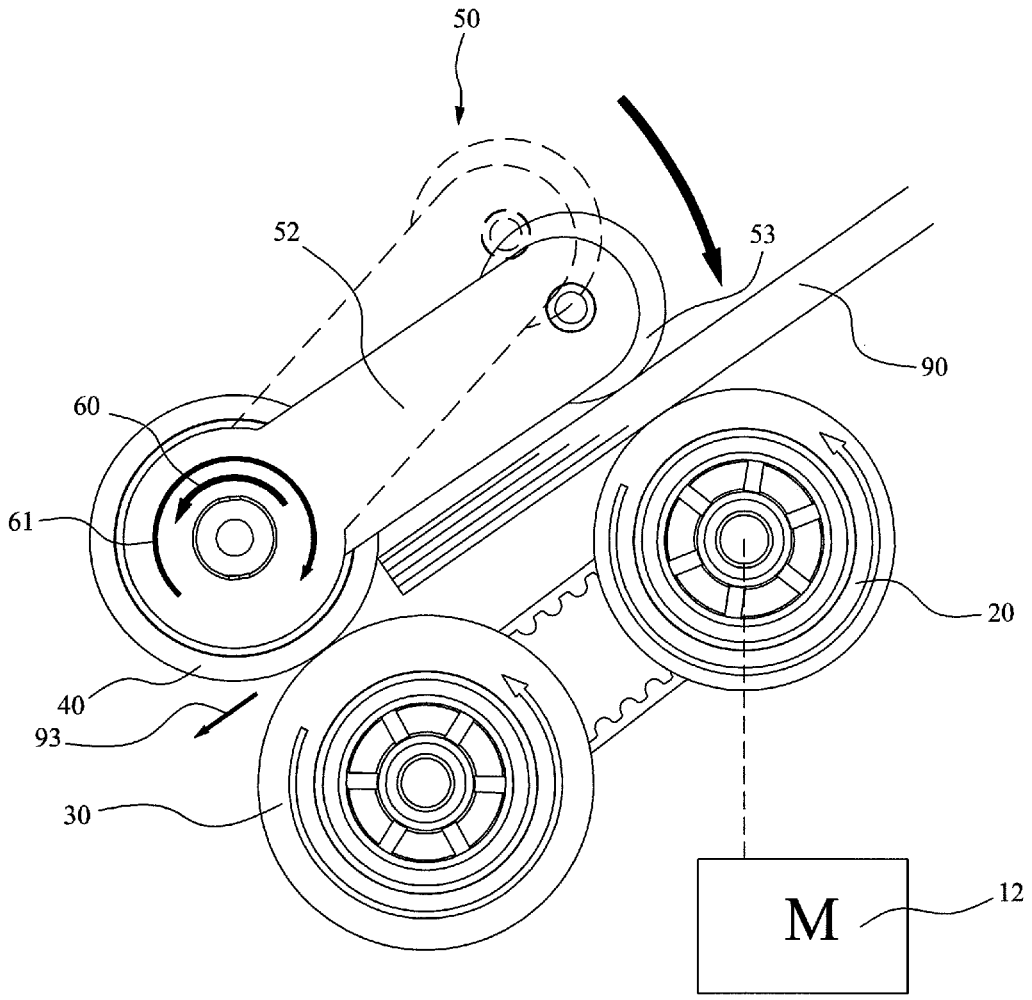
FIG. 4 shows a cross-sectional view of the feeding apparatus shown in FIG. 3, wherein a pressing structure of the feeding apparatus is swung towards a pickup roller.

Referring to FIG. 3 and FIG. 4, in this embodiment, the pickup roller 20 is linked with the separating roller 30 by a belt 13, and driven by a driving motor 12. So when the driving motor 12 turns on, the pickup roller 20 and the separating roller 30 will rotate and start to convey the medium 90.

The brake roller 40 is arranged on the top side of the conveying path 93, and abuts against the separating roller 30. The brake roller 40 is a retard roller without being connected with power source but only abutting against the separating roller 30 and is driven by the frictional force between the brake roller 40 and the separating roller 30.

Figure 6:
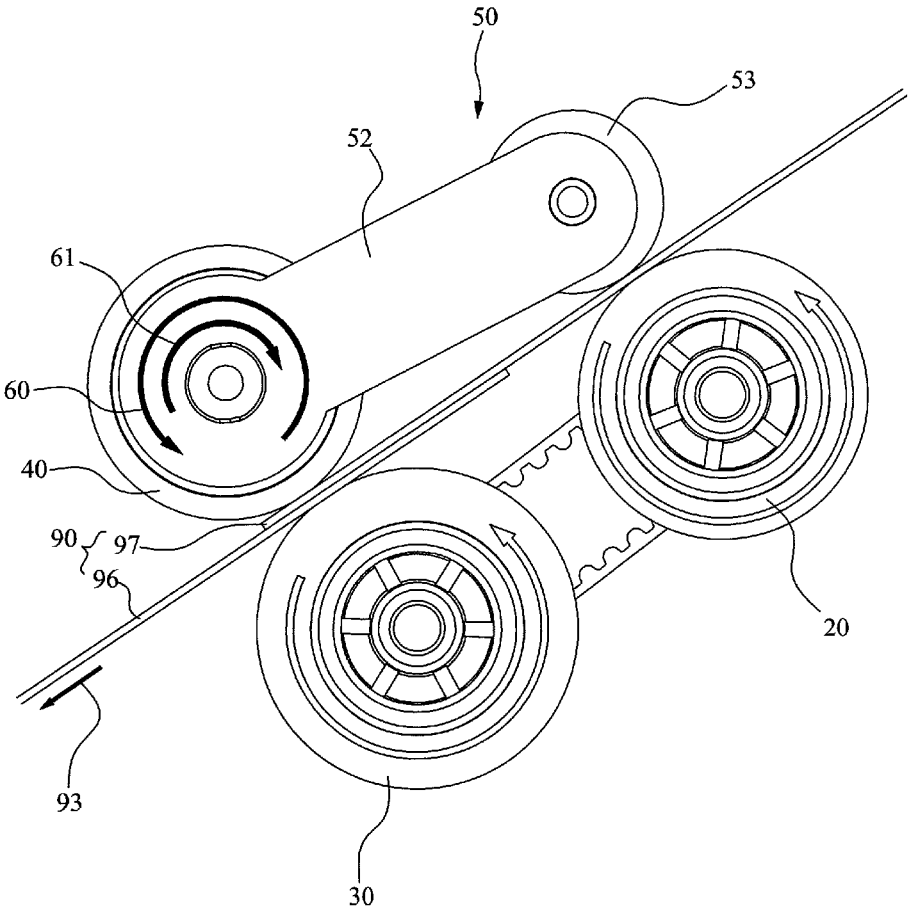
FIG. 6 shows a cross-sectional view of the feeding apparatus of FIG. 3, wherein the feeding apparatus is picking up multiple mediums.

Therefore, when there are more than one medium 90 fed between the separating roller 30 and the brake roller 40 (as shown in FIG. 6), the brake roller 40 will not rotate along with the separating roller 30 due to a respective slide occurred between a first medium 96 and a second medium 97. The frictional force used for driving the brake roller 40 will be intercepted by the respective slide. In resolute, the brake roller 40 will stop rotating along with the separating roller 30 and suppress the second medium 97 that isn't contacted with the separating roller 30 from transmitting downstream in the conveying path 93.

Referring to FIG. 3 and FIG. 4, the pressing structure 50 includes a pressing arm 52 with the brake roller 40 and the pressing part being pivoted at two opposite ends thereof. The first torque limiter 51 is located between the brake roller 40 and the corresponding end of the pressing arm 52 and controls the swing of the pressing part via the pressing arm 52. The brake roller 40 is coaxial to the corresponding end of the pressing arm 52 and has a permissible upstream limit torque that is smaller than a driving force used to transfer one medium 90 by the separating roller 30 and greater than a frictional force generated between adjacent mediums 90 stacked one on another. In the first embodiment, the pressing part is a pressing roller 53 pivoted at the corresponding end of the pressing arm 52, and the mediums 90 are located between the pickup roller 20 and the pressing roller 53. The pressing arm 52 is capable to swing the pressing roller 53 toward the pickup roller 20 when the brake roller 40 rotates along with the separating roller 30, so as to adjust the normal force between the pickup roller 20 and the medium 90.

In other hand, when the pressing roller 53 applies normal force to the medium 90, the medium 90 will also reapply a reacting force to the pressing roller 53. The reacting force will be transmitted back to the brake roller 40 via the pressing arm 52 and the first torque limiter 51. The reacting force will generate an upstream braking torque 60 for stopping the brake roller 40 from rotating along with the separating roller 30, and further stopping the mediums 90 upstream.

The feeding processes of the feeding apparatus 10 in this invention are shown in FIG. 4 to FIG. 8. Referring to FIG. 4 now, at the beginning, the user issues an instruction for feeding mediums 90, then the feeding apparatus 10 starts the driving motor 12 to drive the pickup roller 20 and the separating roller 30 to rotate. When there is no medium 90 fed between the separating roller 30 and the brake roller 40, the brake roller 40 is capable to rotate along with the separating roller 30 by the drive of the friction force between the separating roller 30 and the brake roller 40. Meanwhile, the pressing structure 50 is driven by the brake roller 40 to swing downward onto the medium 90 for applying a normal force to the medium 90. When the normal force reaches a predetermined value, the medium 90 will be transmitted downstream in the conveying path 93 by the pickup roller 20.

Figure 5:
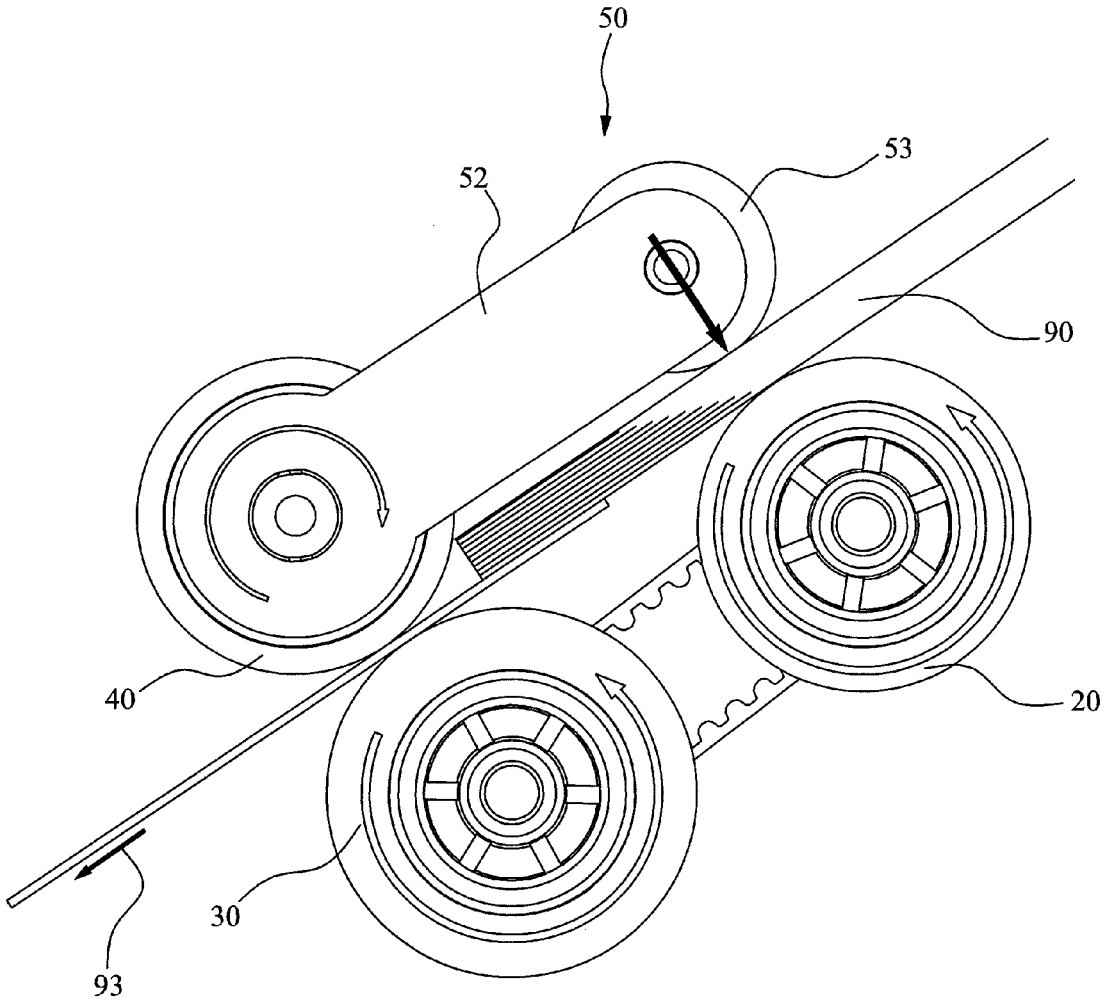
FIG. 5 shows a cross-sectional view of the feeding apparatus of FIG. 3, wherein the feeding apparatus feeds a single sheet-like medium.

Referring to FIG. 5 now, when a sheet of medium 90 is fed between the separating roller 30 and the brake roller 40, the separating roller 30 and the brake roller 40 will be separated by the medium 90. However, the frictional force that drives the brake roller 40 downstream can still be transferred to the brake roller 40 via the medium 90, so the brake roller 40 can still rotate along with the separating roller 30, the pressing structure 50 can still apply the normal force to the medium 90, and the pickup roller 20 can also still pick the mediums 90 in this case.

Referring to FIG. 6, when two mediums 90 (a first medium 96 and a second medium 97) are fed between the separating roller 30 and the brake roller 40. The first medium 96 that contacts with the separating roller 30 will keep moving downstream by the drive of the separating roller 30, but the second medium 97 that doesn't contact with the separating roller 30 will stop moving with the brake roller 40 because the upstream braking torque 60 is greater than the frictional force between the first medium 96 and the second medium 97. As a resolute, the pressing structure 50 driven by the brake roller 40 will also stop applying normal force to the medium 90 due to the stop of the brake roller 40. It will reduce the friction force between the pickup roller 20 and the medium 90, so as to avoid more mediums 90 being fed between the separating roller 30 and the brake roller 40, and effectively avoid the occurrence of multiple feed.

Figure 7:
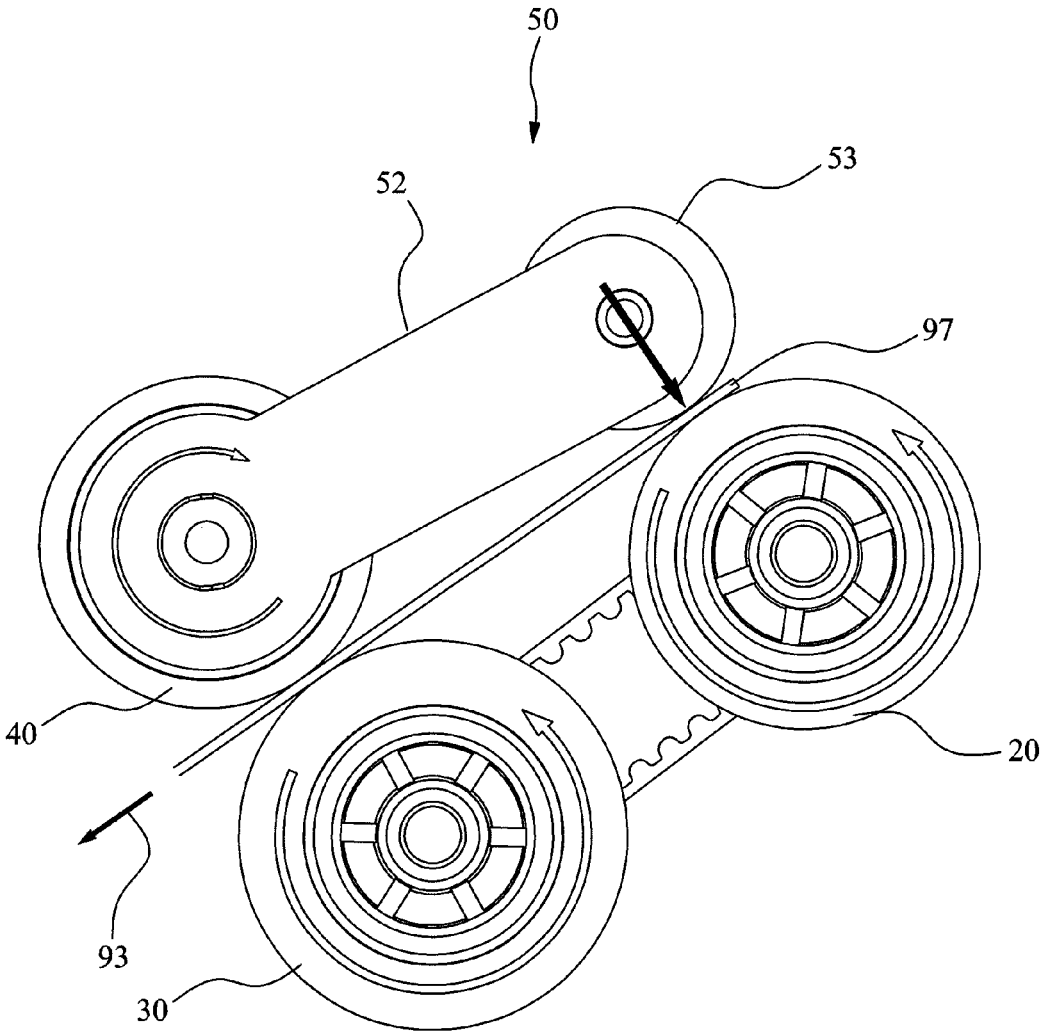
FIG. 7 shows a cross-sectional view of the feeding apparatus of FIG. 3, wherein the feeding apparatus feeds the last one medium.

Referring to FIG. 7, after the first medium 96 is completely transmitted downstream out of the separating roller 30 and only the second medium 97 is left between the separating roller 30 and the brake roller 40, the second medium 97 contacts with the separating roller 30 again. With the drive of the separating roller 30, the brake roller 40 together with the pressing structure 50 will resume to rotate and apply normal force to the second medium 97.

Figure 8:
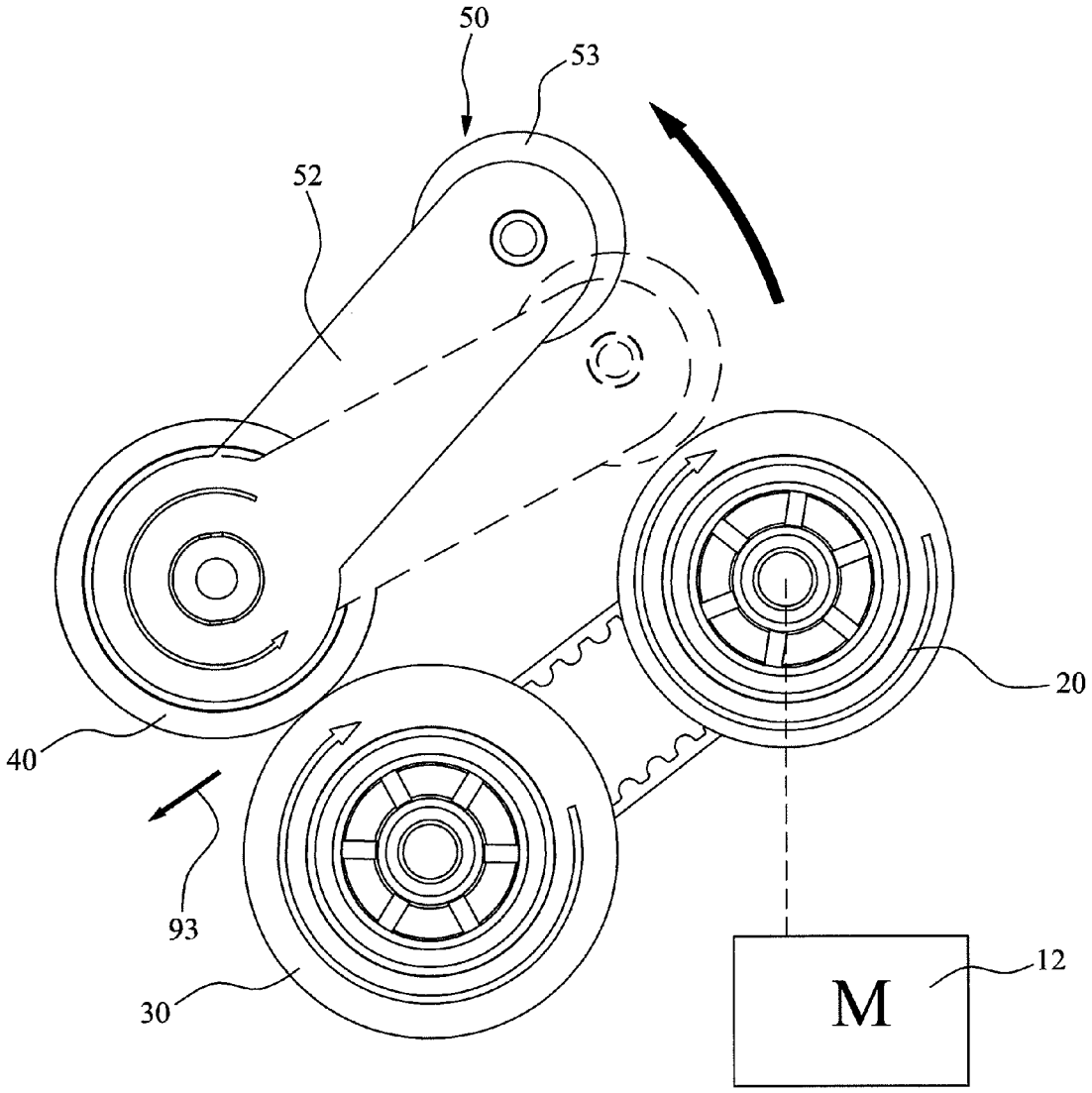
FIG. 8 shows a cross-sectional view of the feeding apparatus of FIG. 3, wherein the feeding apparatus is swung away from the pickup roller and returning to the standby position after all of the mediums have been fed.

Referring to FIG. 8, after all of the mediums 90 are fed, the driving motor 12 reverses to drive the separating roller 30 to rotate upstream and further drive the brake roller 40 to rotate upstream, so that drives the pressing arm 52 to move from the sheet-feeding position (shown in dotted line) to the standby position (shown in solid line) for the convenience of placing mediums 90 on a supporter 91 (shown in FIG. 2) and further between the pickup roller 20 and the pressing structure 50.

Figure 9:
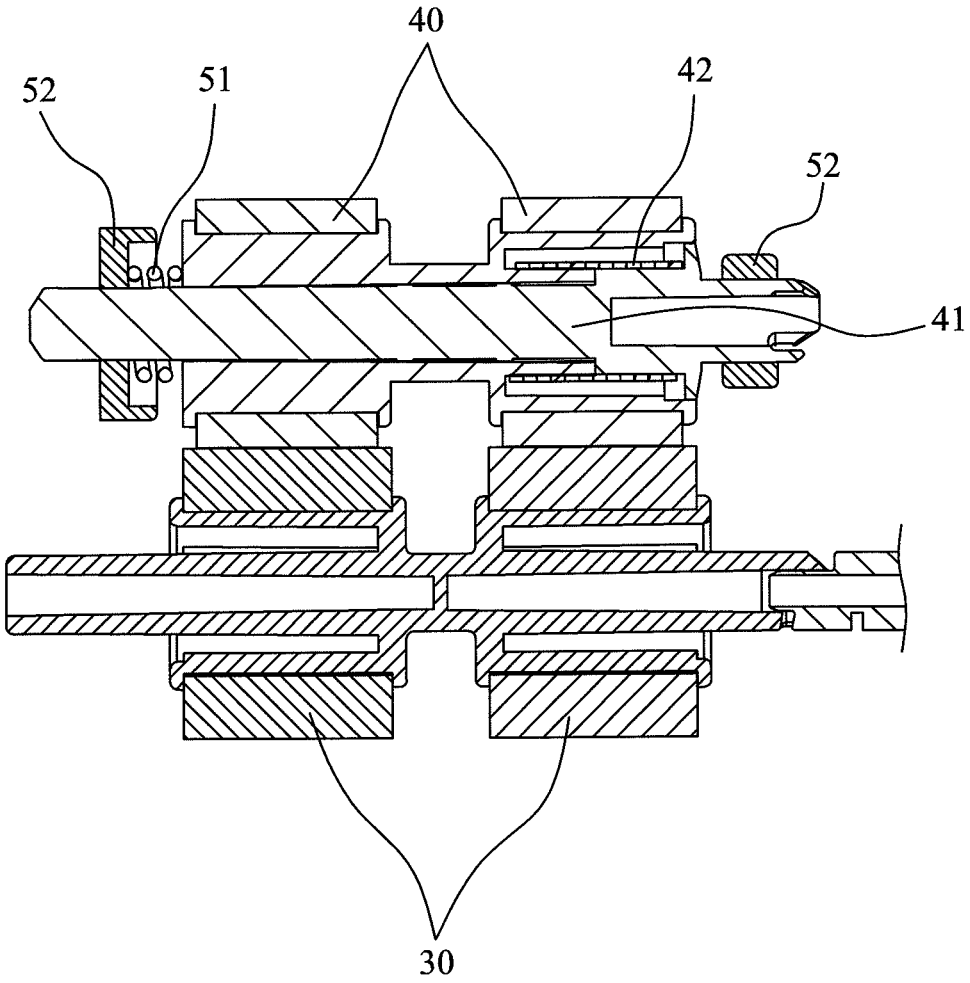
FIG. 9 shows a cross-sectional view of a brake roller and a separating roller of a feeding apparatus in accordance of a second embodiment of this invention.

Referring to FIG. 9, in a second embodiment of the present invention, in order to increase the flexibility for designing the value of the braking torque, a second torque limiter 42 is further connected between the brake roller 40 and a fixed axle 41 of the brake roller 40 so as to apply a braking torque to the brake roller 40 with the aid of the fixed axle 41. Thus, even when the pressing structure 50 is not yet contacted with the medium 90, the brake roller 40 can still apply a braking force to the medium 90 with the braking torque generated by the second torque limiter 42. The normal force applied to the medium 90 is decided by the first torque limiter 51, but the braking torque applied to the brake roller 40 is decided by the first torque limiter 51 and the second torque limiter 42 together, so the normal force and the braking torque can now be decided independently to increase the flexibility of design.

Figure 10:
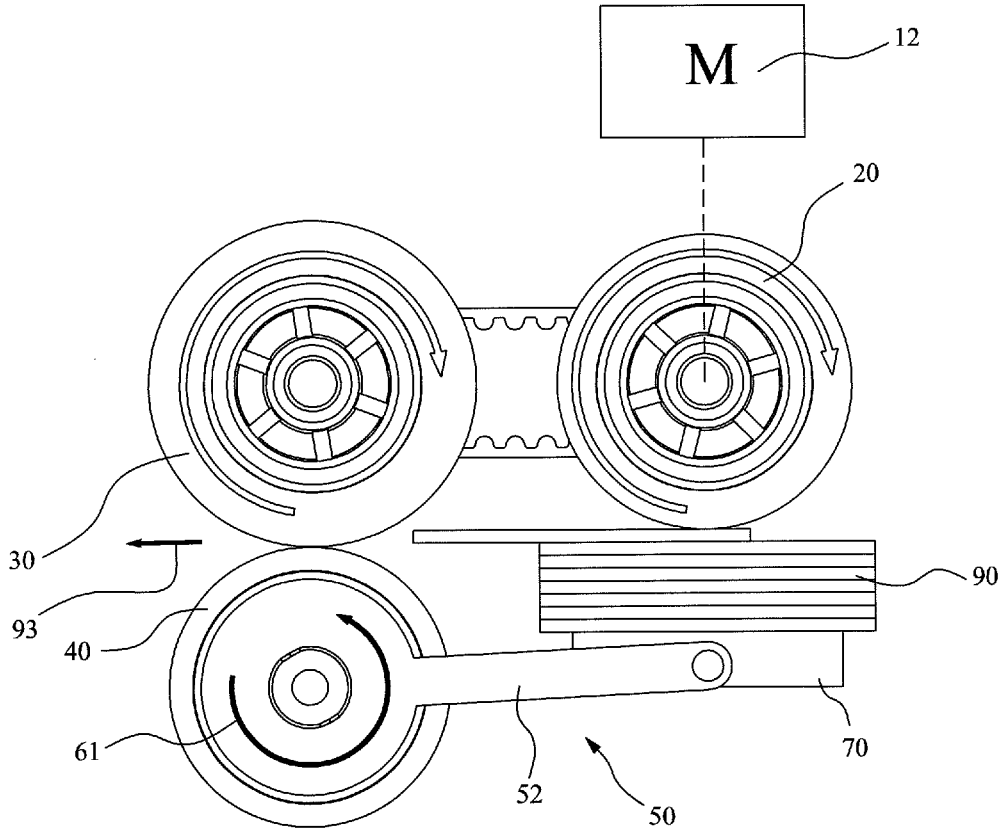
FIG. 10 shows a cross-sectional view of a feeding apparatus in accordance with a third embodiment of this invention.

Referring to FIG. 10, in a third embodiment of the present invention, the pressing part is a floating tray 70 for loading the mediums 90 thereon. In this embodiment, the pickup roller 20 is provided at the top side of the conveying path 93. The separating roller 30 and the brake roller 40 are also located downstream to the pickup roller 20, but the separating roller 30 is provided at the top side of the conveying path 93 and the brake roller 40 is provided at the bottom side of the conveying path 93 accordingly. The pressing structure 50 is accordingly located at the bottom side of the conveying path 93 with the floating tray 70 facing to the pickup roller 20. Therefore, when the pickup roller 20 and the separating roller 30 are rotated downstream in the conveying path 93, the frictional force acted to the brake roller 40 will produce a driving torque 61 to lift the pressing arm 52 and the floating tray 70 so as to bring the mediums 90 towards the pickup roller 20 and further apply a normal force to the medium 90.

Figure 11:
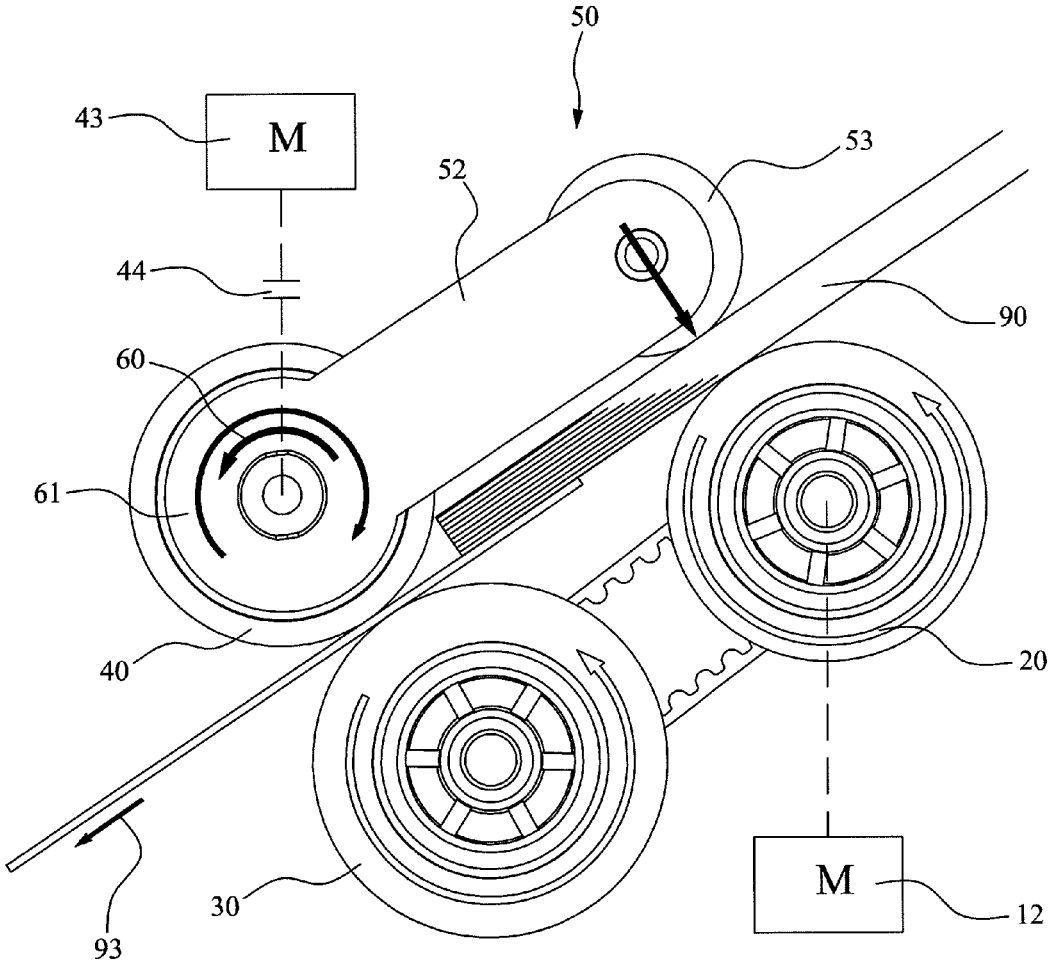
FIG. 11 shows a cross-sectional view of a feeding apparatus in accordance with a fourth embodiment of this invention, wherein the feeding apparatus feeds a single medium.
Figure 12:
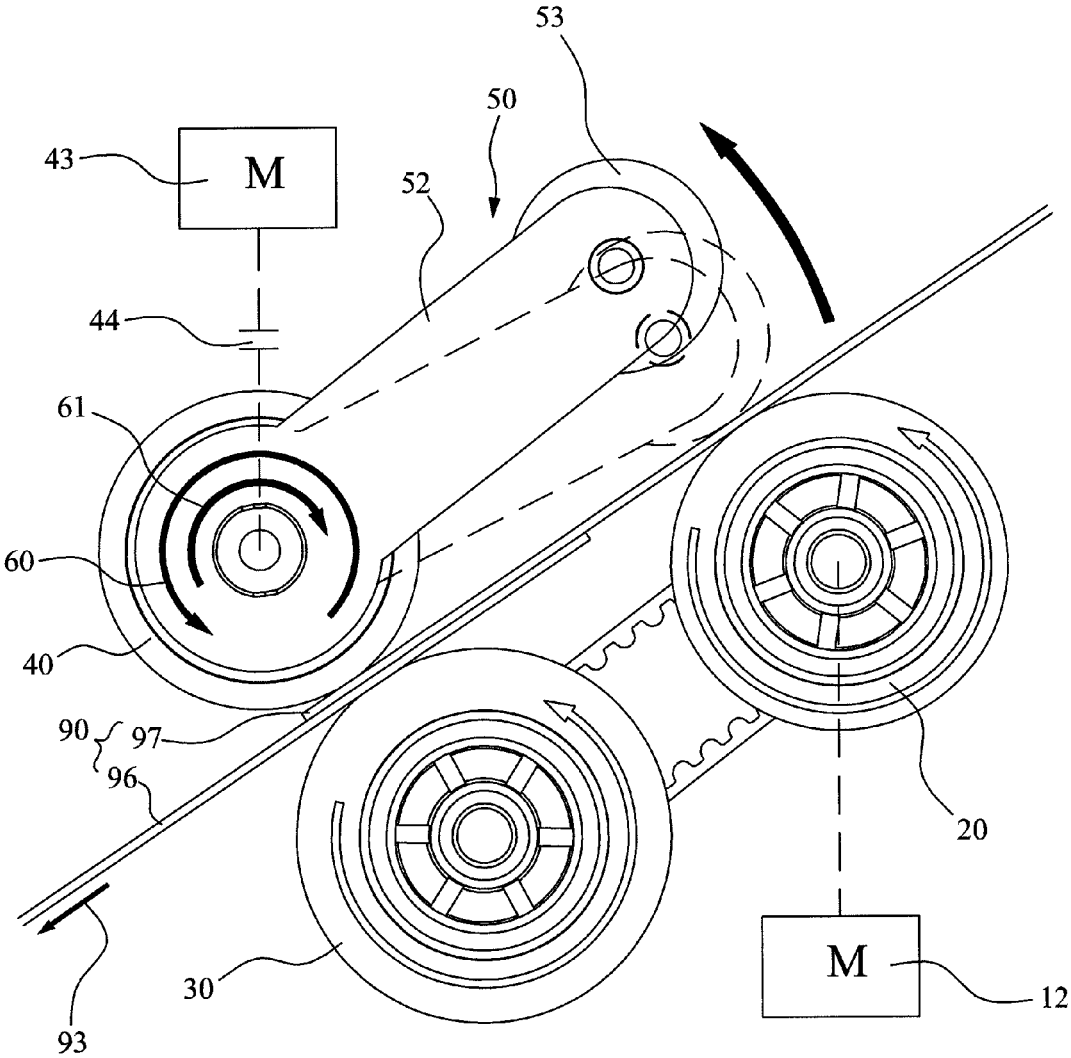
FIG. 12 is a cross-sectional view of the feeding apparatus of FIG. 11, wherein the feeding apparatus is picking up multiple mediums.

Referring to FIG. 11 and FIG. 12, a feeding apparatus 10 according to a fourth embodiment of the present invention is shown. The difference of the feeding apparatus 10 between the fourth embodiment and the first embodiment is that the brake roller 40 is further connected with a reversing motor 43 via a third torque limiter 44 in the fourth embodiment. The third torque limiter 44 has a permissible upstream limit torque that is smaller than a driving force used to transfer one medium 90 by the separating roller 30 and greater than a frictional force generated between adjacent mediums 90 stacked one on top another. The third torque limiter 44 provides an upstream braking force for the brake roller 40 via the drive of the reversing motor 43.

Therefore, when only one medium 90 is transmitted between the separating roller 30 and the brake roller 40 (as shown in FIG. 11), the brake roller 40 rotates along with the separating roller 30 downstream and drives the pressing structure 50 to swing the pressing part toward the pickup roller 20 by virtue of the first torque limiter 51 so as to apply the normal force onto the mediums 90 for the convenience of the pickup roller 20 picking the medium 90. When more than one medium 90 are transmitted between the separating roller 30 and the brake roller 40 (such as the first medium 96 and the second medium 97 shown in FIG. 12), the brake roller 40 is driven by the third torque limiter 44 via the reversing motor 43 to rotate upstream because the friction forces among the mediums 90 are smaller than the braking force of the brake roller 40 so as to transmit the mediums 90 which are not contacted with the separating roller 30 back upstream along the conveying path 93. The brake roller 40 further drives the pressing structure 50 to swing the pressing part away from the pickup roller 20 by virtue of the first torque limiter 51 so as to release the normal force between the pickup roller 20 and the medium 90 and avoid more mediums 90 being further transmitted downstream.

As described above, the pressing structure 50 is linked with the brake roller 40 and receives the driving torque for applying normal force to the medium 90 from the brake roller 40. Therefore, when multiple mediums 90 are fed between the separating roller 30 and the brake roller 40, the pressing structure 50 will lost the driving torque from the brake roller 40 and cut off the normal force and the friction force between the pickup roller 20 and the medium 90 automatically. As a resolute, the pickup roller 20 can no longer pick and feed the medium 90 when there are more than one medium 90 between the separating roller 30 and the brake roller 40, to reduce the occurrence of multiple feed. In addition, the overall structure of the feeding apparatus 10 of the present invention is very simple and the normal force applied by the pressing structure 50 can be automatically regulated via the cooperation of the brake roller 40, the pressing structure 50 and the first torque limiter 51 without setting any sensor or control unit.

What is claimed is:

1. A feeding apparatus adapted for an office machine, the office machine defining a conveying path for transmitting sheet-like mediums therethrough, the feeding apparatus being arranged on the conveying path and comprising:

a pickup roller that is arranged to contact with the mediums and rotatable to transmit each medium downstream along the conveying path;

a separating roller that is arranged downstream to the pickup roller in the conveying path for receiving each medium transmitted by the pickup roller, the separating roller being rotatable to further advance each medium downstream along the conveying path;

a brake roller that is arranged opposite to the separating roller for applying a braking force upstream; and a pressing structure including a pressing part that is arranged opposite to the pickup roller, a pressing arm with the brake roller and the pressing part being pivoted at two opposite ends thereof, and a first torque limiter being connected coaxially between the brake roller and the corresponding end of the pressing arm to control swing of the pressing part via the pressing arm according to a rotating direction of the brake roller, wherein when only one medium is transmitted between the separating roller and the brake roller, the brake roller rotates along with the separating roller downstream and drives the pressing structure to swing the pressing part toward the pickup roller by virtue of the first torque limiter so as to apply a normal force onto the only one medium for the convenience of the pickup roller picking the only one medium, when more than one medium are transmitted between the separating roller and the brake roller, the brake roller stops rotating along with the separating roller and stops mediums, of the more than one medium, which are not contacted with the separating roller because friction forces among the mediums are smaller than the braking force of the brake roller, the brake roller further drives the pressing structure to swing the pressing part away from the pickup roller by virtue of the first torque limiter so as to reduce the normal force between the pickup roller and the current medium being transmitted by the pickup roller and avoid more mediums from being further transmitted downstream.

2. The feeding apparatus as claimed in claim 1, wherein the pressing part is a pressing roller and the mediums are located between the pickup roller and the pressing roller.

3. The feeding apparatus as claimed in claim 1, wherein a second torque limiter is further connected between the brake roller and a fixed axle of the brake roller to increase the flexibility for designing the upstream braking force for the brake roller.

* * * * *